US007296505B2

(12) United States Patent
Balbo et al.

(10) Patent No.: US 7,296,505 B2
(45) Date of Patent: Nov. 20, 2007

(54) MUZZLE BRAKES FOR WEAPONS

(75) Inventors: Patrick Balbo, Bourges (FR); Jean-Luc Gilberton, Sennecay (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 11/130,183

(22) Filed: May 17, 2005

(65) Prior Publication Data

US 2005/0252365 A1 Nov. 17, 2005

(51) Int. Cl.
*F41A 21/36* (2006.01)

(52) U.S. Cl. ..... 89/14.3; 89/14.05

(58) Field of Classification Search ..... 89/14, 89/15, 16; 42/77, 79
See application file for complete search history.

(56) References Cited

U.S. PATENT DOCUMENTS

| | | | | |
|---|---|---|---|---|
| 1,227,544 | A * | 5/1917 | Lobdell | 356/255 |
| 2,206,568 | A | 7/1940 | Hughes | |
| 2,457,802 | A * | 1/1949 | Bauer | 89/14.3 |
| 2,567,826 | A | 9/1951 | Prache | |
| 3,714,864 | A * | 2/1973 | Thierry | 89/14.3 |
| 5,675,107 | A * | 10/1997 | Ledys et al. | 89/14.3 |
| 6,216,578 | B1 | 4/2001 | Ledys et al. | |
| 6,276,251 | B1 * | 8/2001 | Downing et al. | 89/14.3 |
| 6,578,462 | B1 * | 6/2003 | Franchino et al. | 89/14.3 |
| 2004/0154462 | A1 * | 8/2004 | Ang | 89/14.2 |

FOREIGN PATENT DOCUMENTS

| | | |
|---|---|---|
| FR | 2 718 839 | 10/1995 |

* cited by examiner

*Primary Examiner*—Michael J. Carone
*Assistant Examiner*—Stewart T Knox
(74) *Attorney, Agent, or Firm*—Steptoe & Johnson LLP

(57) ABSTRACT

A muzzle brake for a gun having a substantially cylindrical body intended to be positioned in the extension of a gun barrel. The body has two stages of propellant gas reception vanes and is perforated by vents directing propellant gas towards the vanes. The brake has one deflector to deflect the flow of gas and is positioned between the vents of the second stage of the vanes and a front profile of the first stage of the vanes.

13 Claims, 7 Drawing Sheets

MUZZLE BRAKES FOR WEAPONS

BACKGROUND OF THE INVENTION

1. Field of Invention

The technical scope of the invention is that of muzzle brakes for weapons.

2. Description of the Related Art

Muzzle brakes are well known to somebody skilled in the art. After firing, they enable part of the propellant gases of a piece of ammunition to be directed towards gas reception vanes integral with the gun barrel. The gases thereby exert a force on the vanes that oppose the recoil stress.

Patent FR2718839 describes such a known muzzle brake.

Generally speaking, a muzzle brake is sought to be designed that is as efficient as possible in its braking capacity but whose mass is as small as possible so as to reduce the mechanical torques on the gun trunnions.

These two requirements are, a priori, contradictory since a simple means of improving efficiency is to increases the reception surfaces for the gases thereby leading to an increase in the dimension and thus the mass of the muzzle brake.

SUMMARY OF THE INVENTION

The aim of the invention is to propose an extremely efficient muzzle brake with a mass that is as low as possible.

A further aim of the invention is to propose means enabling a muzzle brake to be simply and reliably joined to a gun barrel.

Thus, the invention relates to a muzzle brake for a gun comprising at least one substantially cylindrical body intended to be positioned in the extension of a gun barrel, such body incorporating at least two stages of gas reception vanes, such body perforated by vents directing the propellant gases towards the vanes, brake wherein it incorporates at least one means to deflect the gas flow, such means positioned between the vents of the second stage of vanes and a front profile of the vanes of the first stage.

According to one characteristic of the invention, the deflector means are constituted by a flange extending angularly over all the width of the front profile of the vanes of the first stage.

The vanes of the second stage may be advantageously shaped as relatively thin dividers having at least one reinforcing rib oriented substantially radially with respect to the brake axis.

Each vane of the second stage may also be connected to a vane of the first stage by relatively thin dividers delimiting a chamber that communicates with the exterior by an opening having a substantially rectangular section, such dividers having at least one second reinforcing rib oriented substantially in parallel to the muzzle axis.

The dividers may have a second reinforcing rib positioned in the vicinity of the mouth of the opening delimited by the dividers, such rib extending longitudinally on either side of the first radial rib and up to the vane of the first stage.

The dividers delimiting each chamber of the second stage may incorporate substantially plane portions parallel to the brake axis and which extend up to the body by plane, substantially radial portions.

The width of the chamber openings in the second stage may be between 100% and 200% of the gun calibre.

The radial portions delimiting each chamber may form an angle between 100° and 150°.

The brake will preferably be made of cast steel or cast titanium, materials having in any case a limit of elasticity greater than or equal to 1000 MPa.

According to another characteristic of the invention, the brake vents may be radial perforations having the profile of extensions slots extending longitudinally over the full length of the chamber.

The muzzle brake will advantageously incorporate two or three vents in each chamber.

According to another characteristic of the invention, the brake may incorporate an internal bore having two different diameters separated by a counter-sink forming an axial limit stop for the gun barrel, a first diameter being equal to the external diameter of a front end of the gun barrel and a second diameter being equal to the calibre of the gun barrel.

According to another characteristic of the invention, the muzzle brake may incorporate an opening intended to receive a cleat to ensure its joining with the gun barrel, such cleat being fastened by flanges to the brake body and incorporating two concurrent plane surfaces intended to cooperate with matching surfaces on the gun barrel so as to prevent the relative rotation of the brake/barrel.

The cleat may advantageously incorporate means to fasten a barrel reflector.

BRIEF DESCRIPTION OF THE DRAWINGS

The invention will become more apparent from the following description made of one embodiment, such description being made with reference to the appended drawings, in which.

DETAILED DESCRIPTION OF PREFERRED EMBODIMENTS

Figure 1:
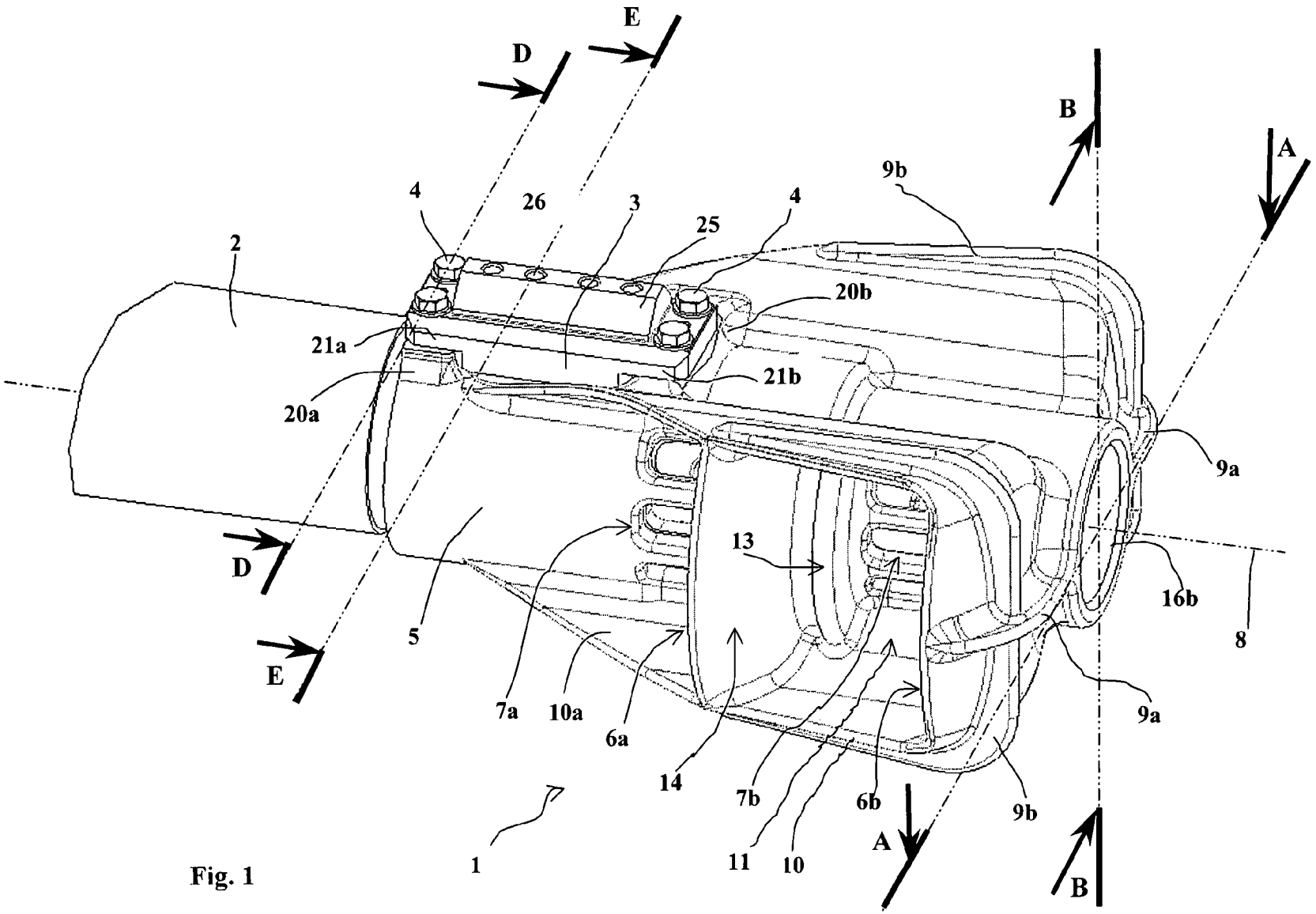
FIG. 1 is a perspective view of a recoil brake according to the invention, fastened to the end of a gun barrel.

With reference to FIG. 1, a muzzle brake 1 according to the invention is shown fastened to the front end of a gun barrel 2. The brake is linked in rotation with the barrel 2 by means of a cleat 3 that is made integral with the brake by four screws 4. This cleat 3 will be described in greater detail hereafter.

The muzzle brake 1 comprises a substantially cylindrical body 5 fastened in the extension of the barrel 2.

Figure 4:
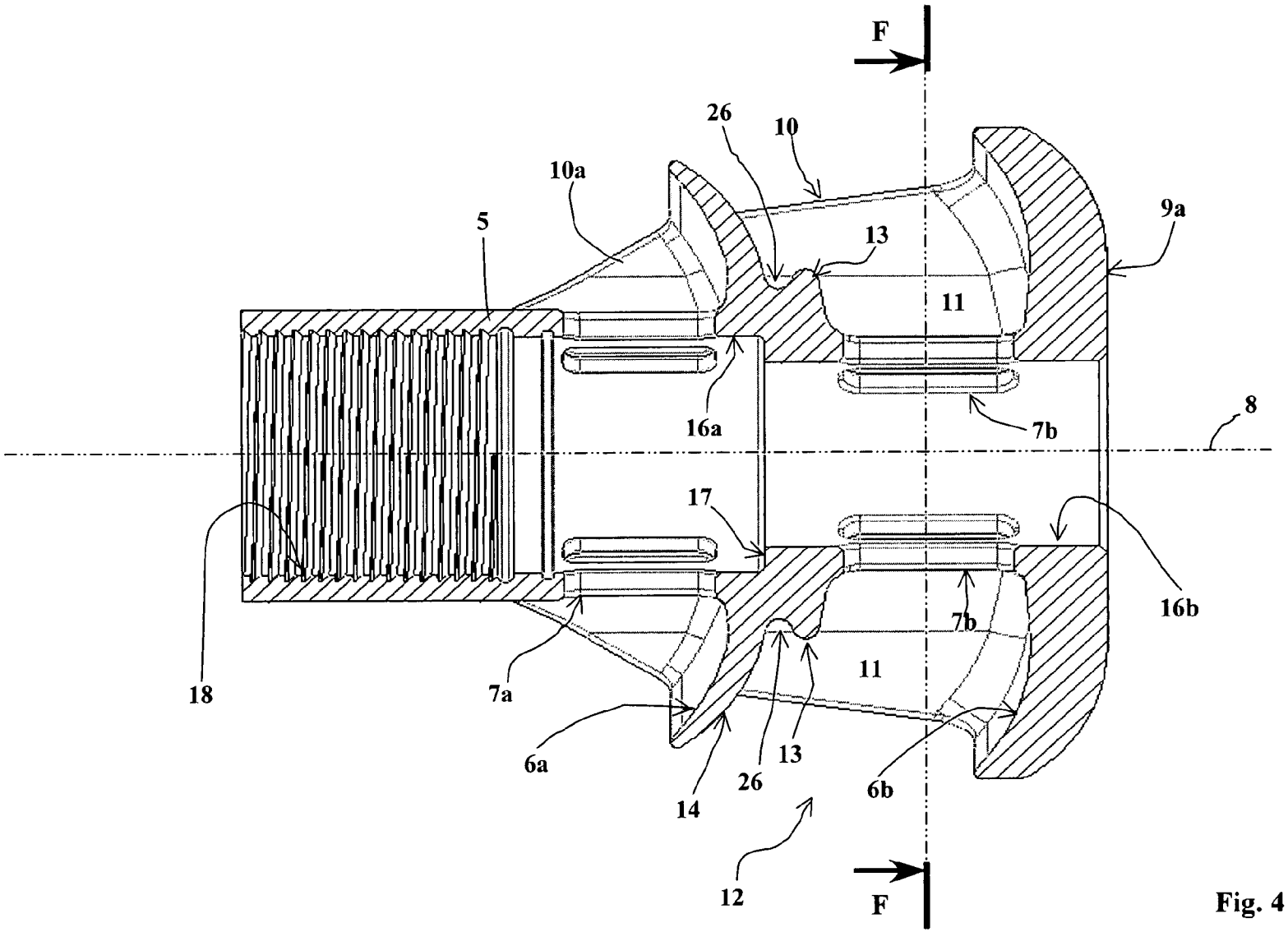
FIG. 4 is a longitudinal section of the brake alone, the section being made along plane AA traced in FIG. 1.

The body 5 has two stages 6*a*, 6*b* of gas reception vanes (refer also to FIG. 4). Each stage thus incorporates two vanes placed symmetrically with respect to a vertical plane (which is also the plane of section BB traced in FIG. 1). Thus, after firing the gases are evacuated following a substantially horizontal plane.

Classically, the body 5 is perforated with vents 7 enabling the propellant gases to be directed towards vanes 6*a* and 6*b*.

The vents directing the gases towards the first stage of vanes 6*a* are designated as 7*a* in the Figures. Those which direct the gases to the second stage of vanes 6*b* are designated 7*b* in the Figures.

Vents 7, here, are radial perforations and are thus perpendicular to the longitudinal axis 8 of the brake 1. They have the profile of elongated slots extending longitudinally for a length that enables their impact on the ammunition to be limited.

In accordance with one characteristic of the invention, the vanes 6*b* of the second stage are formed into relatively thin dividers (of a thickness less than 10 mm) provided with reinforcing ribs 9.

Thus, each vane 6*b* of the second stage is connected to a vane 6*a* of the first stage by relatively thin dividers 10 (of a thickness less than 10 mm) which delimit a chamber 11 communicating with the exterior by an opening 12 with a substantially rectangular section (refer in particular to FIGS. 1 and 4).

These dividers 10 extend beyond the vanes 6*a* of the first stage by panels 10*a* connected to the body 5 and thus delimiting two other chambers surrounding the vents 7*a* in the first stage.

As is more particularly visible in FIG. 1, the dividers 10 have a first reinforcing rib 9*a* oriented substantially radially with respect to the brake axis 8.

Figure 2:
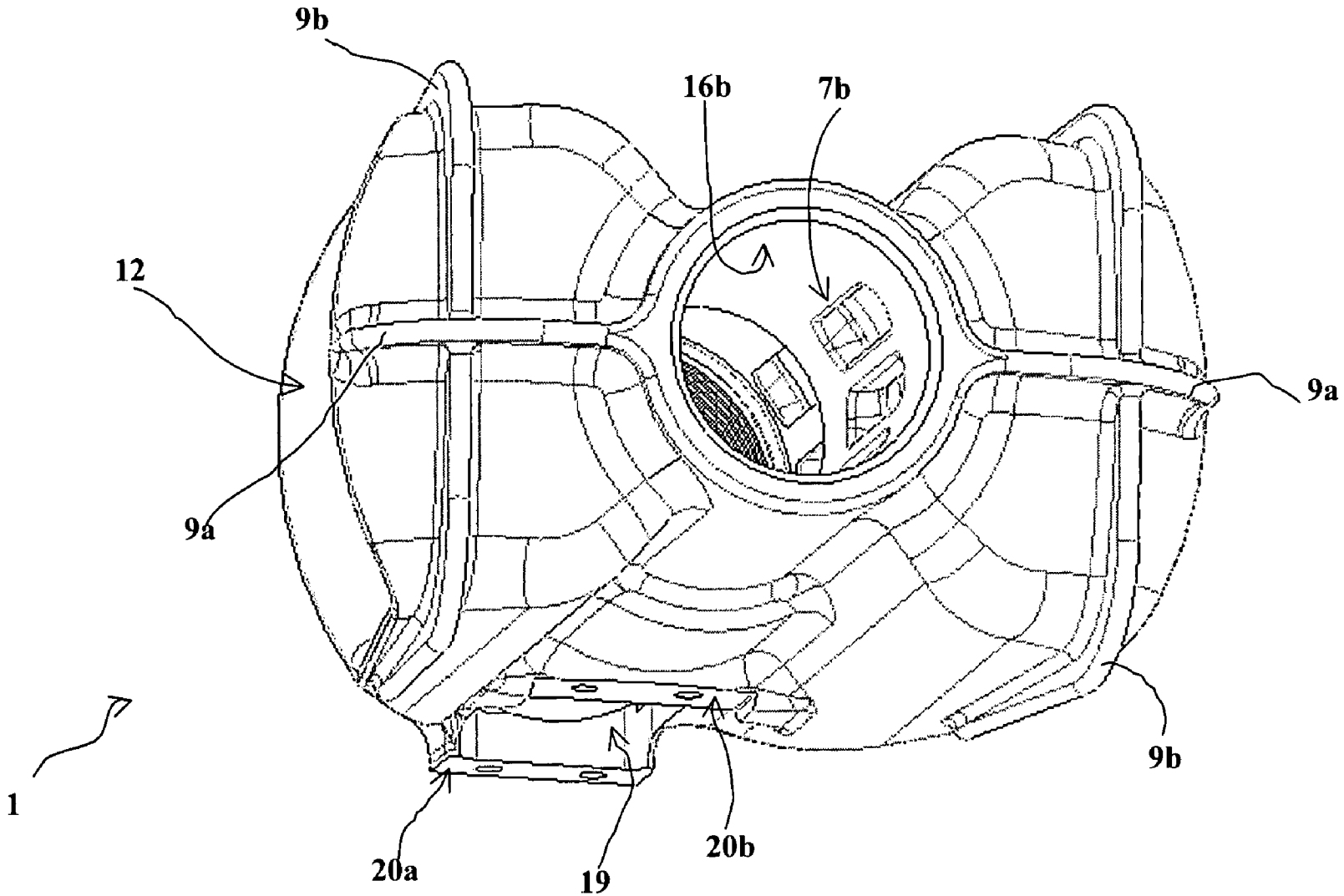
FIGS. 2 and 3 are two other perspective views of the brake shown alone.

Furthermore, the dividers 10 also incorporate a second reinforcing rib 9*b* positioned in the vicinity of the mouth of the opening 12 delimited by the dividers 10 (see also FIGS. 2 and 3) and which three-quarter surrounds this opening.

This rib 9*b* extends longitudinally on either side of the radial rib 9*a* and up to the vane 6*a* of the first stage. Each longitudinal rib 9*a* is thus oriented substantially in parallel to the brake axis 8.

This design of the brake stages in the form of thin ribbed dividers enables the muzzle brake to be made considerably lighter whilst retaining its mechanical strength.

The material implemented to make the brake will be a cast steel having high mechanical strength (limit of elasticity (Rp0.2) greater or equal to 1000 MPa. The brake may also be made of cast titanium that has a similar limit of elasticity.

The first reinforcing rib 9*a* (or front rib) limits the deformation of the vent 6*b* under the effect of the gas pressure.

The second reinforcing rib 9*b* (or peripheral rib) reinforces the dividers 10 delimiting the chambers 11 preventing them from opening under the effect of the gas pressure.

Figure 7:
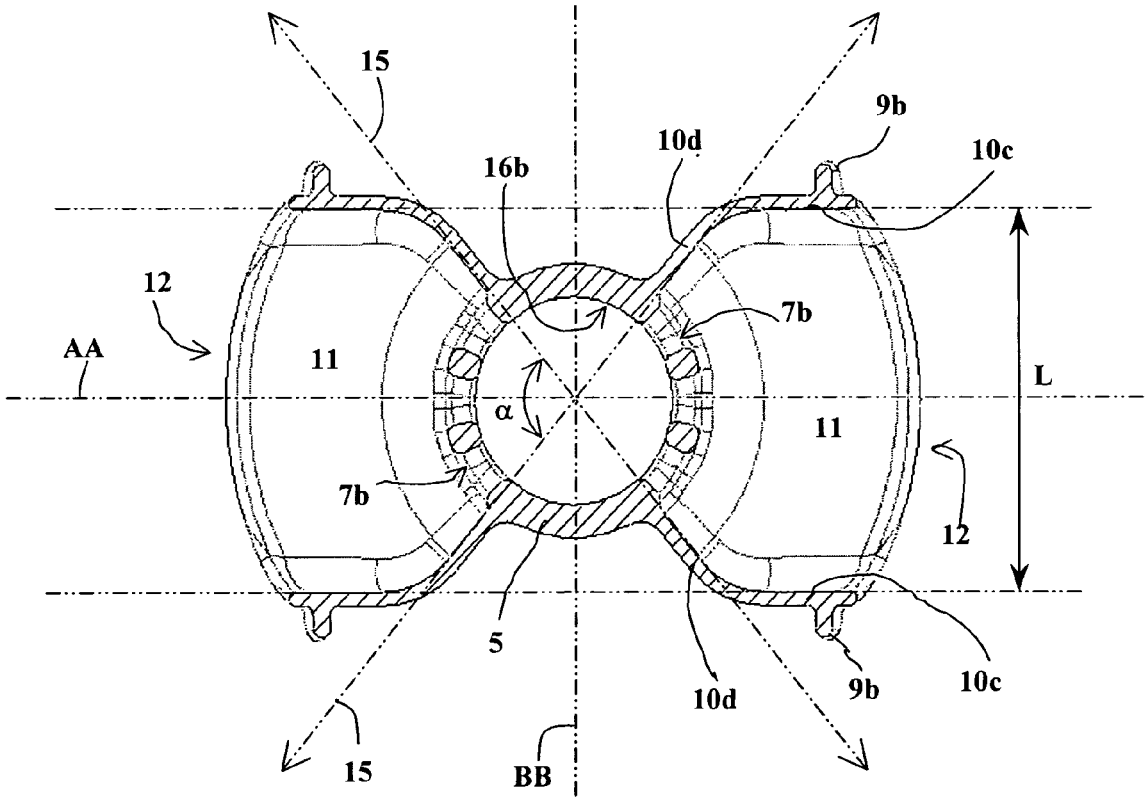
FIG. 7 is a transversal section of the brake along plane FF traced in FIG. 4, FIGS. 8 and 9 are two transversal sections of the brake mounted on a gun barrel; these sections are made respectively along planes DD and EE traced in FIG. 1.

Moreover, and as may be more particularly seen in FIG. 7, the dividers 10 delimiting the chambers 11 of the second stage incorporate portions 10*c* that are substantially plane and parallel to the axis 8 of the brake 1 (and to the horizontal plane AA). These plane portions 10*c* partially delimit the rectangular opening 12.

The plane portions 10*c* extend up to the body 5 of the brake 1 by plane portions 10*d* that are oriented substantially radially with respect to the body 5 of the brake 1.

The plane portions 10*d* define plane radial planes 15 (or opening planes for the chambers 11 of the brake 1) which together form an angle □ of around 120° (this angle may be of 100° to 150°).

Three vents 7*b* are positioned in each chamber 11. The vents are evenly spaced angularly in an opening sector of 120°.

The width L of the chamber 12 openings in the second stage is thus between 100% and 200% of the calibre of the weapon.

Such an arrangement, for a given calibre, facilitates maximal withdrawal of gas and thus maximal braking efficiency. The gases are then evacuated after being channeled by the plane portions 10*c*. The gases are thus ejected in a horizontal direction parallel to plane AA.

According to an important characteristic of the invention, the brake incorporates at least one means 13 to deflect the gas flow, such means being positioned between the vents 7*b* of the second stage of vanes and the front profile 14 of the vanes of the first stage (see FIGS. 1 and 4).

The deflector means are constituted by a flange 13 extending angularly over the full length of the front profile 14 of the vanes 6*a* of the first stage, thus over the full angular sector α delimited by the radial planes 15.

The flange 13 is succeeded by a groove 26. This results in the aerodynamic flow being deviated upon exiting the vents 7*b*. This further results in a depression in the groove 26 and along the front profile 14. The pressure exerted along the front profile 14 is thereby limited, pressure which would otherwise exert an effect opposing the braking. The global performance of the brake is thus improved. Moreover, the deflector 13 enables the gas ejection rate to be increased further improving the performance of the muzzle brake.

With respect to a classical brake incorporating two stages of vanes, the brake according to the invention has a mass reduced by 10 to 20% (this thanks to the partitioned structure). Moreover, its performance is improved by 5 to 10% thanks to the deflector and to the chamber profile.

Figure 5:
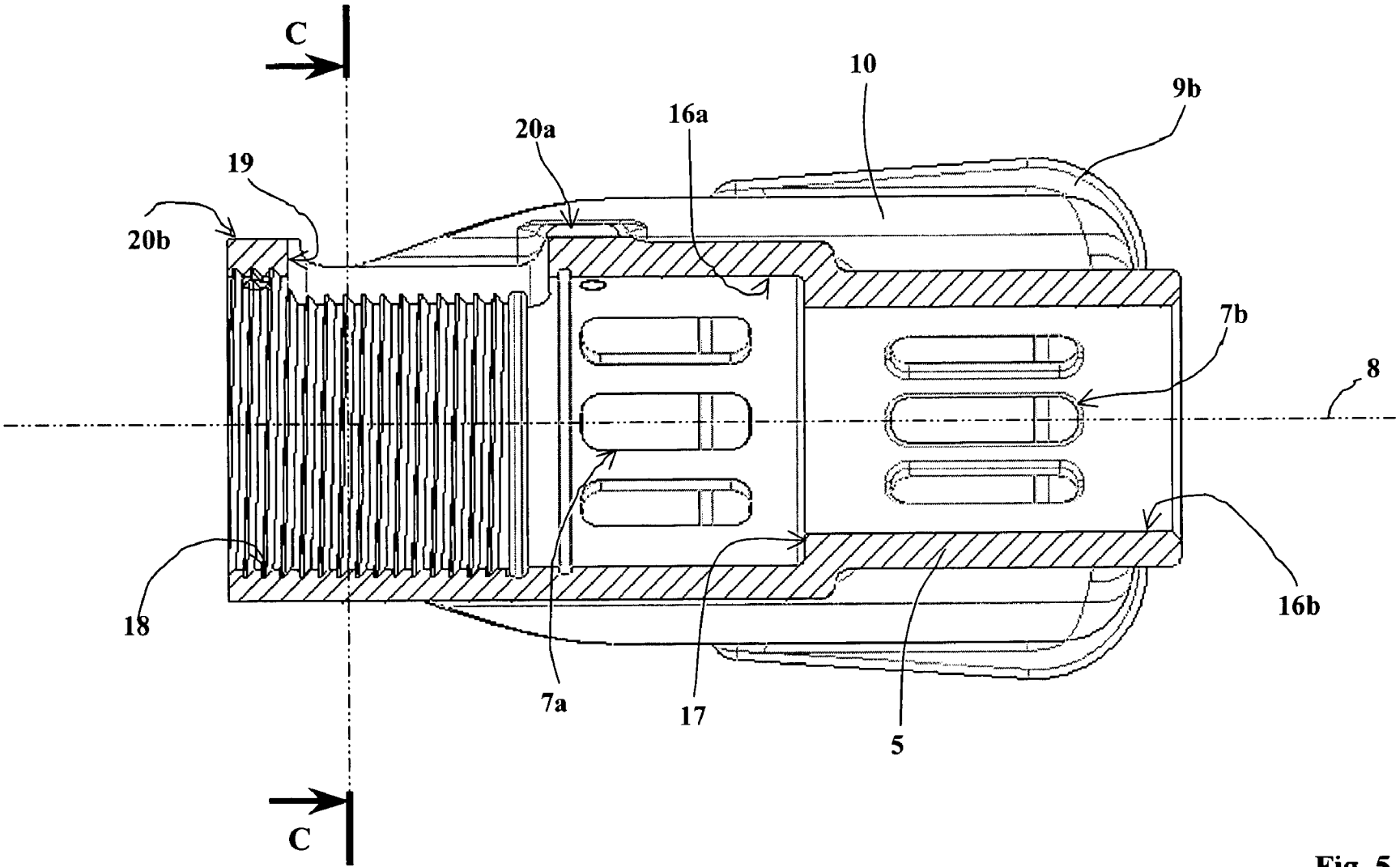
FIG. 5 is another longitudinal section view along plane BB perpendicular to the previous one, this plane being traced in FIG. 1.
Figure 6:
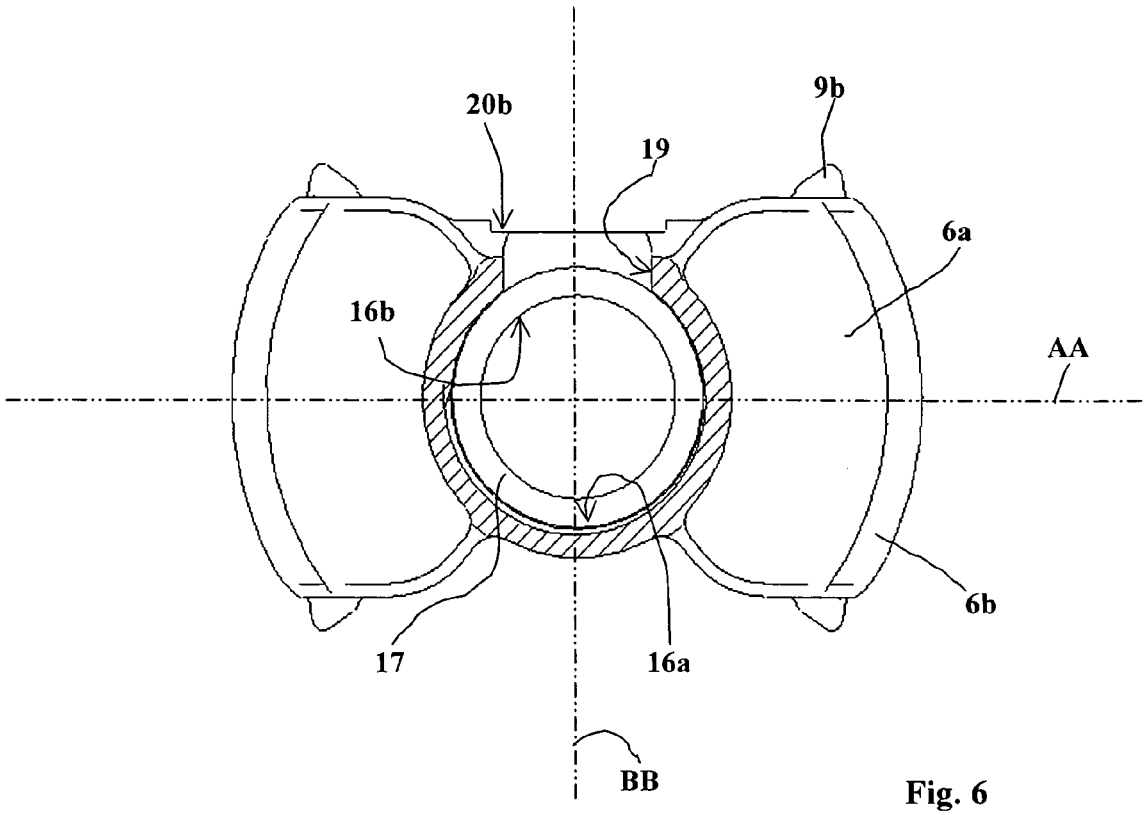
FIG. 6 is a transversal section of the brake alone, such section made along plane CC traced in FIG. 5.

Reference to FIGS. 4 and 5 reveals that the brake body 5 incorporates an inner bore which is in two parts 16*a* and 16*b* each with a different diameter and separated by a counter-sink 17 forming an axial limit stop for the gun barrel 2.

The rear part 16*a* has a diameter equal to the external diameter of the front end of the gun barrel 2. The front part 16*b* has a diameter equal to the calibre of the gun barrel. Thus, the counter-sink 17 is equal to the thickness of the gun barrel 2. Thus, after firing, a projectile is guided inside the muzzle brake as it is inside the gun barrel.

The rear part 16*a* of the bore has artillery threading 18 intended to allow the brake 1 to be screwed onto the gun barrel 2 which has matching threading.

The gun barrel 2 naturally incorporates a smooth forward seat (not shown) extending its threaded part, such seat fitting into the rear part 16*a* of the bore. This forward seat incorporates oblong drill holes (not shown) positioned angularly such that they lie opposite the vents 7*a* of the first stage of the muzzle brake.

Such a structure of the perforated gun barrel whose drill holes cooperate with the vents of a muzzle brake is well known, namely by patent FR2718839. It is thus unnecessary to describe this structure of the barrel 2 in any further detail.

In accordance with another characteristic of the invention, the muzzle brake 1 incorporates an opening 19 intended to receive the cleat 3 ensuring it is joined with the gun barrel 2.

Figure 3:
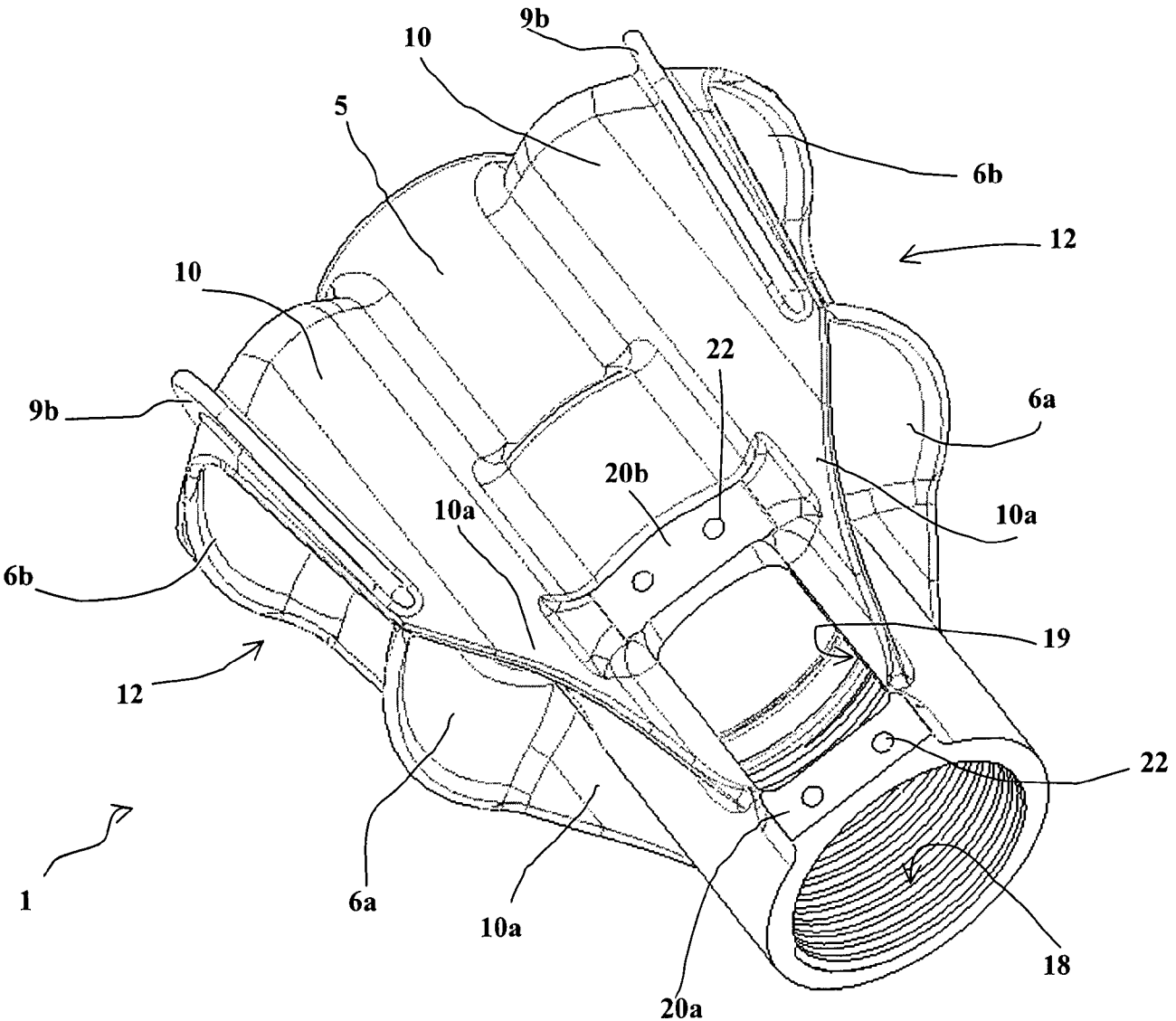

This opening is globally rectangular in shape. It is housed between the upper panels 10*a* delimiting the chambers surrounding the vents 7*a* of the first stage. Two extra thicknesses 20*a* and 20*b* of the brake body 5 are positioned on either side of the opening 19 (FIG. 3). They are intended to act as bearing surfaces for flanges 21*a* and 21*b* integral with the cleat 3 (see FIG. 1).

These extra thicknesses are threaded 22 (see FIG. 3) so as to receive screws 4 to attach the cleat 3.

Figure 8:
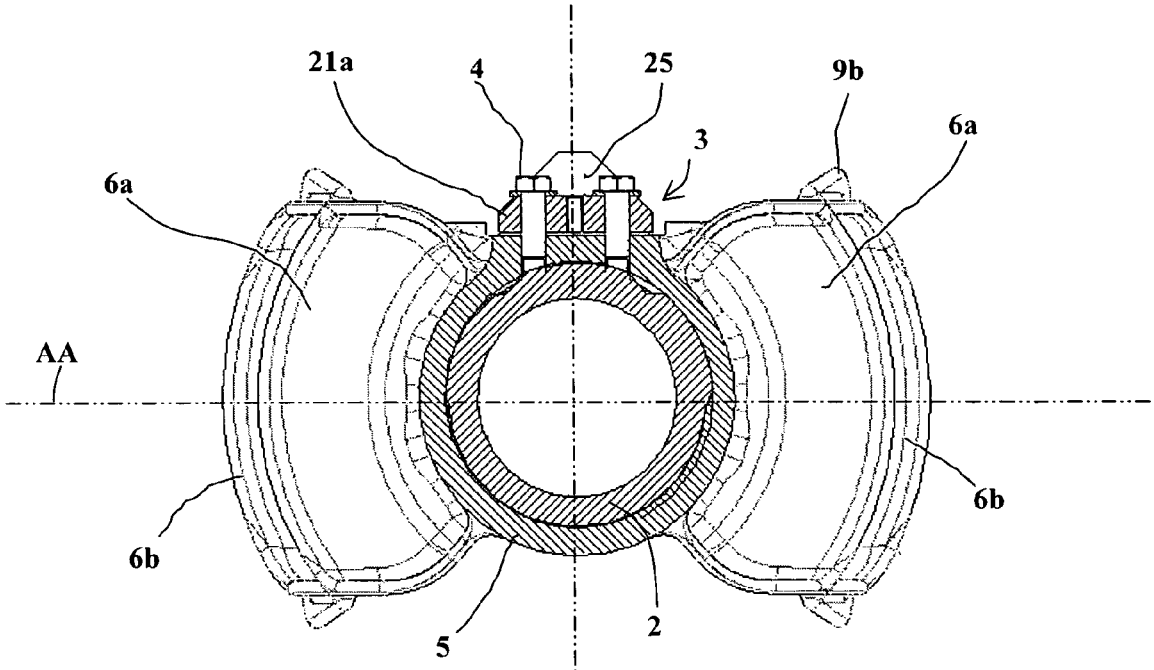
Figure 9:
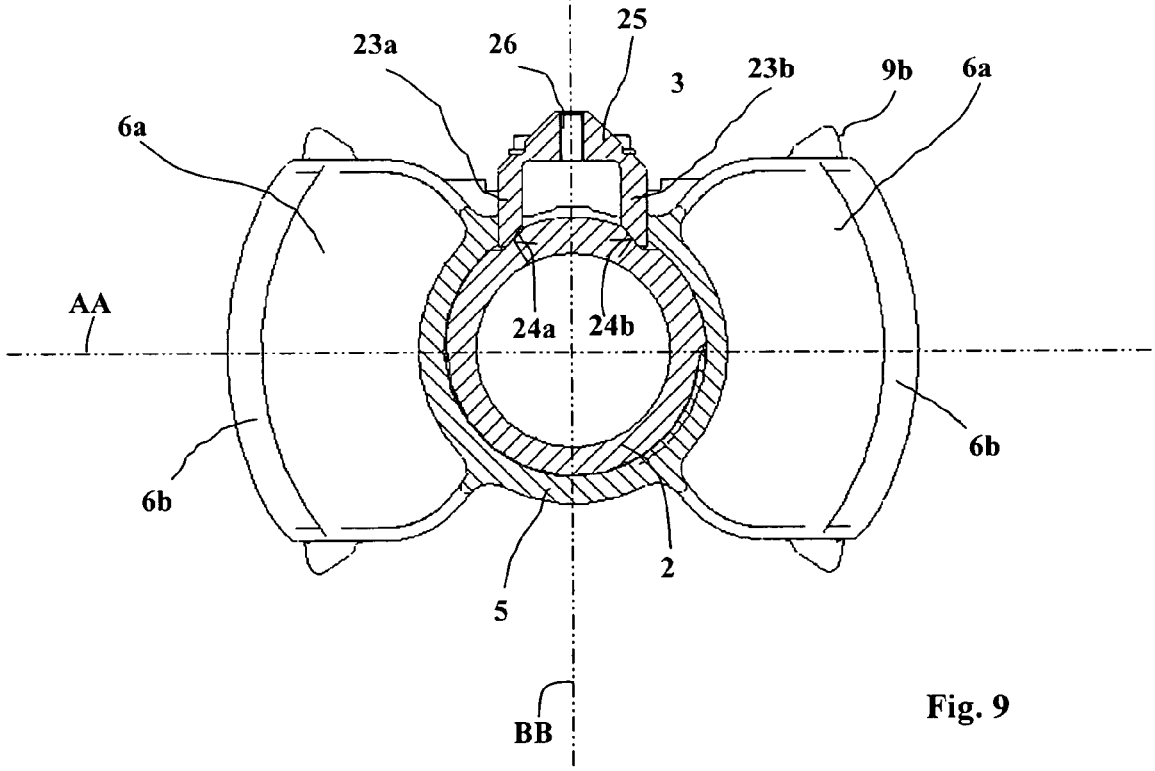

As may be more particularly seen in FIGS. 8 and 9, the cleat 4 incorporates two longitudinal tongues 23*a* and 23*b*, between the flanges 21*a* and 21*b*, each incorporating a plane end surface 24*a*, 24*b* which is intended to come into contact with a matching plane surface on the gun barrel 2.

The end surfaces 24*a* and 24*b* are concurrent. Thus, when they are applied against the barrel 2 they prevent any relative rotation of the brake 1 with respect to the barrel 2.

The brake is thus very simply joined to the gun barrel. Indeed, its axial immobilization is obtained by the abutment of the end of the barrel 2 against the counter-sink 17. Its immobilization in rotation is then ensured by simply fastening the cleat 3 in the opening 19.

Advantageously, the cleat 3 will incorporate a prismatic extension 25 on its upper part which will enable a barrel reflector to be affixed. This may be done simply by means of the threading 26.

Such an arrangement simplifies the fastening of such mirrors. Indeed, in a known manner these mirrors are reference means enabling the fire control to know the actual geometric position of the end of a gun barrel.

For firing to be accurate, it is thus essential for the mirror to be exactly positioned with respect to the barrel. Here, thanks to the invention, the position of the extension 25 with respect to the barrel is precisely controlled since this extension is integral with the tongues 24*a*, 24*b* which press directly on the barrel 2.

Thus, the cleat 3 proposed by the invention enables the muzzle brake to be joined whilst providing a spatial reference of the end of the gun barrel.

Such a cleat may naturally be implemented with another type of muzzle brake.

What is claimed is:

1. A muzzle brake for a gun, comprising at least one substantially cylindrical body for positioning in a gun barrel extension, said body comprising at least two stages of propellant gas reception vanes each extending generally radially outwardly from the cylindrical body, said vanes arranged in first and second stages, said second stage located in the breech-to-muzzle direction from said first stage, said body perforated by vents for directing propellant gas towards said vanes, said brake further comprising at least one deflector to deflect the flow of propellant gas, said deflector positioned between the vents of the second stage of said vanes and a front profile of the first stage of said vanes, said deflector comprising a flange extending through the entire circumferential length of the front profile of said vanes of said first stage; and a groove extending circumferentially between said flange and the vanes of the first stage, the radial extent of the deflector at the bottom of the groove being substantially less than the radial extent of the adjacent flange portion of the deflector.

2. The muzzle brake according to claim 1, said vanes of said second stage having at least one reinforcing rib oriented substantially radially with respect to an axis of the brake.

3. The muzzle brake according to claim 2, wherein each of said vanes of said second stage is connected to a vane of said first stage by thin, substantially planar dividers extending generally parallel to the axis of the cylindrical body and between the vanes of the first and second stages, also extending radially from the cylindrical body, and delimiting a plurality of chamber each of which communicates with the exterior of said brake by an opening having a substantially rectangular section.

4. The muzzle brake according to claim 3, wherein said dividers have a second reinforcing rib positioned in the vicinity of the mouth of said opening delimited by said dividers, said rib extending axially on either side of a first radial rib and up to said vane of said first stage.

5. The muzzle brake according to claim 4, wherein said dividers delimiting each chamber of said second stage incorporate planar portions parallel to said brake axis and extending to said body.

6. The muzzle brake according to claim 5, wherein the width of an opening in said chamber in said second stage is between 100% and 200% of the calibre of a gun barrel on which said brake is usable.

7. The muzzle brake according to claim 5, wherein said radial divider portions delimiting each chamber form a radial angle in the range between 100° and 150°.

8. The muzzle brake according to claim 1, wherein said brake comprises at least one material selected from the group consisting of cast steel, titanium, and a material having a limit of elasticity greater than or equal to 1000 MPa.

9. The muzzle brake according to claim 3, wherein said vents are radial perforations extending axially over the full length of each chamber.

10. The muzzle brake according to claim 9, said brake further comprising at least two vents in each of said chambers.

11. The muzzle brake according to claim 1, said brake further comprising at least an internal bore having two different diameters separated by a conical secter surface as an axial limit stop for said gun barrel, a first diameter equal to the external diameter of a front end of a gun barrel on which said brake is usable and a second diameter equal to the caliber of such a gun barrel.

12. The muzzle brake according to claim 1, said brake further comprising at least an opening for receiving a cleat for joining with a gun barrel, said cleat for being fastened by flanges to said brake body and comprising two concurrent plane surfaces for cooperating with matching surfaces on a gun barrel to prevent relative rotation between said brake and a barrel.

13. The muzzle brake according to claim 12, said cleat comprising means for fastening a reflector to a gun barrel.

* * * * *